US007980688B2

(12) United States Patent
Nakashima et al.

(10) Patent No.: US 7,980,688 B2
(45) Date of Patent: Jul. 19, 2011

(54) INKJET RECORDING APPARATUS

(75) Inventors: Atsuhisa Nakashima, Nagoya (JP); Susumu Kuzuya, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 975 days.

(21) Appl. No.: 11/839,003

(22) Filed: Aug. 15, 2007

(65) Prior Publication Data

US 2008/0043052 A1 Feb. 21, 2008

(30) Foreign Application Priority Data

Aug. 16, 2006 (JP) ..... 2006-221823

(51) Int. Cl.
*B41J 29/38* (2006.01)
*B41J 2/01* (2006.01)

(52) U.S. Cl. ..... 347/104; 347/16

(58) Field of Classification Search ..... 347/16, 347/104

See application file for complete search history.

(56) References Cited

U.S. PATENT DOCUMENTS

| | | | | |
|---|---|---|---|---|
| 4,898,375 | A | 2/1990 | Holtje | |
| 5,536,000 | A | 7/1996 | Kelly | |
| 5,815,282 | A | 9/1998 | Kano | |
| 5,940,092 | A * | 8/1999 | Kashimura et al. | 347/8 |
| 7,093,932 | B2 | 8/2006 | Inokuchi et al. | |
| 7,163,280 | B2 | 1/2007 | Watanabe | |
| 7,401,915 | B2 | 7/2008 | Sasa et al. | |
| 2004/0036738 | A1 * | 2/2004 | Lorenz et al. | 347/37 |
| 2005/0275150 | A1 | 12/2005 | Cook et al. | |
| 2006/0028500 | A1 | 2/2006 | Sakaida et al. | |
| 2006/0028507 | A1 | 2/2006 | Sakaida et al. | |
| 2006/0050101 | A1 | 3/2006 | Sakaida | |
| 2006/0066883 | A1 * | 3/2006 | Takagi | 358/1.12 |
| 2006/0071390 | A1 * | 4/2006 | Johnson et al. | 271/10.01 |

FOREIGN PATENT DOCUMENTS

| | | | |
|---|---|---|---|
| JP | S61-110654 | U | 7/1986 |
| JP | S62-086356 | U | 6/1987 |

(Continued)

OTHER PUBLICATIONS

European Patent Office; Search Report in European Patent Application No. 07253113.0 (counterpart to the above-captioned U.S. patent application) mailed Mar. 17, 2010.

Japanese Patent Office, Notification of Reason for Refusal for Japanese Patent Application No. 2006-221823 (counterpart to above-captioned patent application), mailed Jul. 22, 2008.

(Continued)

*Primary Examiner* — Matthew Luu
*Assistant Examiner* — Kendrick X Liu
(74) *Attorney, Agent, or Firm* — Baker Botts L.L.P.

(57) ABSTRACT

An inkjet recording apparatus includes: (a) a first medium accommodator configured to accommodate a recording medium; (b) a medium supporter having a flat horizontal surface on which the recording medium is to be supported; (c) an inkjet head having a nozzle opening surface that is opposed to the flat horizontal surface of the medium supporter; (d) a first medium feeder configured to horizontally feed the recording medium accommodated in the first medium accommodator, in a medium loading direction, such that the recording medium is fed onto the flat horizontal surface of the medium supporter; (e) a second medium feeder configured to horizontally feed the recording medium supported on the flat horizontal surface of the medium supporter, in a medium unloading direction that intersects the medium loading direction in a plan view as seen in a direction perpendicular to the flat horizontal surface of the medium supporter; and (f) a second medium accommodator configured to accommodate the recording medium that is fed in the medium unloading direction by the second medium feeder.

16 Claims, 7 Drawing Sheets

FOREIGN PATENT DOCUMENTS

| | | | |
|---|---|---|---|
| JP | 2003-237158 | A | 8/2003 |
| JP | 2005-014445 | A | 1/2005 |
| JP | 2005059339 | A | 3/2005 |
| JP | 2006044111 | A | 2/2006 |
| JP | 2006-096534 | A | 4/2006 |
| JP | 2006-176294 | A | 7/2006 |

OTHER PUBLICATIONS

European Patent Office, European Search Report for European Patent Application No. 07253113.0 (counterpart to above-captioned patent application), dated Jun. 23, 2010.

* cited by examiner

INKJET RECORDING APPARATUS

This application claims priority from Japanese Patent Application No. 2006-221823 filed on Aug. 16, 2006, the disclosure of which is herein incorporated by reference in its entirety.

BACKGROUND OF THE INVENTION

1. Field of the Invention

The present invention relates to an inkjet recording apparatus for performing a recording operation by ejecting ink toward a recording medium.

2. Discussion of Related Art

U.S. Patent Application Publications US 2006/0028500 A1, US 2006/0028507 A1 and US 2006/0050101 A1 (corresponding to JP-2006-44111A) disclose an inkjet printer including: four line-type inkjet heads; an input sheet accommodator disposed below the inkjet heads and configured to accommodate a media sheet as a recording medium; a feeder belt disposed between the input sheet accommodator and the inkjet heads and having some degree of stickiness; and an output sheet accommodator disposed above the inkjet heads and configured to accommodate the media sheet that has been subjected to a recording operation. In this inkjet printer, the media sheet is fed from the input sheet accommodator onto the feeder belt via two pairs of feed rollers, and the media sheet held by the feeder belt owing to the stickiness is then is fed to an opposed position opposed to the inkjet heads. The recording operation is performed on the media sheet thus positioned in the opposed position, by casing ink to be ejected from each inkjet head toward the positioned media sheet. After being subjected to the recording operation, the media sheet is separated by a separator plate from the feeder belt, and the separated media sheet is then fed by two pairs of feed rollers toward the output sheet accommodator.

In the above-described inkjet printer, the media sheet is inevitably bent or curved by the two pairs of feed rollers while being fed from the input sheet accommodator to the feeder belt. Where the media sheet is provided by a relatively rigid sheet such as post card or business card, the media sheet is likely to be curled (i.e., remain bent or curved) even after its passage through the two pairs of feed roller, so that the media sheet could be fed to the opposed position (opposed to the inkjet heads) with the media sheet only partially sticks onto the feeder belt. Particularly, if a leading end of the media sheet is not held on the feeder belt, there would be a risk that the leading end of the media sheet might be brought into contact with nozzle opening surfaces of the respective inkjet heads since a space between an outer circumferential surface of the feeder belt and the nozzle opening surfaces of the inkjet heads is small. The contact of the leading end of the media sheet with the nozzle opening surfaces of the respective inkjet heads could result in problematic jamming of the media sheet between the feeder belt and the inkjet heads.

U.S. Pat. No. 7,163,280 (corresponding to JP-2005-59339A) disclose an inkjet printer including: four line-type inkjet heads; a feeder belt disposed in a position opposed to ink opening surfaces of the respective inkjet heads; and input and output sheet accommodators that are disposed in respective opposite sides of the inkjet heads in a direction parallel to the nozzle opening surfaces. In this inkjet printer, the media sheet accommodated in the input sheet accommodator is fed onto the feeder belt without the media sheet being substantially curved by a pair of feed rollers (that are disposed between the input sheet accommodator and the feeder belt), and sticks to the feeder belt so as to be held in the feeder belt.

A recording operation is performed on the media sheet fed by the feeder belt, by causing ink to be ejected from the inkjet heads onto the media sheet. The media sheet, after having been subjected to the recording operation, is separated by a separator from the feeder belt, and is then fed to the output sheet accommodator. Thus, in this inkjet printer, the media sheet is not substantially bent or curved while being fed from the input media accommodator onto the feeder belt, so that the media sheet in its entirety sticks onto the feeder belt so as to be reliably held on the feeder belt, thereby making it possible to avoid contact of the media sheet with nozzle opening surfaces of the respective inkjet heads and accordingly eliminate a risk of jamming of the media sheet between the feeder belt and the inkjet heads.

SUMMARY OF THE INVENTION

In the above-described inkjet printer disclosed in U.S. Pat. No. 7,163,280, the input and output sheet accommodators are disposed on the respective opposite sides of the inkjet heads, so that a loading direction in which the media sheet is fed from the input sheet accommodator onto the feeder belt and an unloading direction in which the media sheet is fed from the feeder belt to the output sheet accommodator coincide with each other, namely, are provided by the same direction. There is a case in which the inkjet printer is installed by an user in a corner portion of a room that is defined by walls intersecting with each other, for example, at about 90°, such that the input sheet accommodator is positioned in a position remote from one of the intersecting walls, for facilitating the user to introduce the media sheet into the input sheet accommodator. However, in such a case, the output sheet accommodator is positioned in a position which is close to the above-described one of the intersecting walls and which is remote from the user, so that it is not easy to take out the media sheet that has been fed to the output sheet accommodator in a direction away from the user toward the one of the intersecting walls. It might be possible to install the inkjet printer with the output sheet accommodator is positioned in a position remote from one of the intersecting walls, for facilitating the user to take out the media sheet from the output sheet accommodator. However, in this case, it is not easy to introduce the media sheet into the input sheet accommodator which is close to the above-described one of the intersecting walls and which is remote from the user.

The present invention was made in view of the background prior art discussed above. It is therefore an object of the invention to provide an inkjet recording apparatus having arrangements which restrains a recording medium from being bent or curved and which facilitates the recording medium to be introduced into and taken out from the recording apparatus. This object may be achieved according to a principle of the invention that is described below.

The principle of the invention provides an inkjet recording apparatus including: (a) a first medium accommodator configured to accommodate a recording medium; (b) a medium supporter having a flat horizontal surface on which the recording medium is to be supported; (c) an inkjet head having a nozzle opening surface that is opposed to the flat horizontal surface of the medium supporter; (d) a first medium feeder configured to horizontally feed the recording medium accommodated in the first medium accommodator, in a medium loading direction, such that the recording medium is fed onto the flat horizontal surface of the medium supporter; (e) a second medium feeder configured to horizontally feed the recording medium supported on the flat horizontal surface of the medium supporter, in a medium unloading direction that intersects the medium loading direction in a plan view as seen in a direction perpendicular to the flat horizontal surface of the medium supporter; and (f) a second medium accommodator configured to accommodate the recording medium that is fed in the medium unloading direction by the second medium feeder.

In the present inkjet recording apparatus, the recording medium is horizontally fed from the first medium accommodator to the second medium accommodator via the flat horizontal surface of the medium supporter by the first and second medium feeders, and the medium loading direction (in which the recording medium is fed from the first medium accommodator onto the flat horizontal surface of the medium supporter) and the medium unloading direction (in which the recording medium is fed from the flat horizontal surface of the medium supporter to the second medium accommodator) intersect each other in the plan view as seen in the direction, so that the recording medium substantially maintains its horizontal posture throughout feed movement of the recording medium from the first medium accommodator to the second medium accommodator. Therefore, the recording medium does not have to be bent or curved in any stage of the feed movement, thereby eliminating a risk of contact of the recording medium with the inkjet head. Further, since the medium loading direction and the medium unloading direction intersect each other, rather than being provided by the same direction, introduction of the recording medium into the first medium accommodator and taking of the recording medium out of the second medium accommodator can be made easily by an user even where the inkjet recording apparatus is installed in a corner portion of a room that is defined by walls intersecting with each other, for example, at about 90°.

According to an advantageous arrangement of the principle of the invention, the first medium accommodator is configured to receive the recording medium introduced thereinto in a medium introducing direction that is opposite to the medium unloading direction. For establishing this arrangement, for example, the first medium accommodator has an medium introducing opening which faces an upstream side of the first medium accommodator in the medium introducing direction and which allows introduction of the recording medium into the first medium accommodator therethrough in the medium introducing direction, while the second medium accommodator is disposed on a downstream side of the medium supporter in the medium unloading direction.

In the inkjet recording apparatus constructed according to this advantageous arrangement, the introduction of the recording medium into the first medium accommodator and the taking of the recording medium out of the second medium accommodator can be made from one side of the inkjet recording apparatus. Therefore, this arrangement makes it possible to install the inkjet recording apparatus even in a recessed space.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

There will be described an inkjet printer 1 that is constructed according to an embodiment of the invention, by reference to the accompanying drawings. It is noted that, in the following description, there will be used terms "upper", "lower", "right", "left", "front" and "rear" directions of the inkjet printer 1 that are indicated by respective arrows "UP", "DOWN", "RIGHT", "LEFT", "FRONT" and "REAR" in FIGS. 1 and 2.

Figure 1:
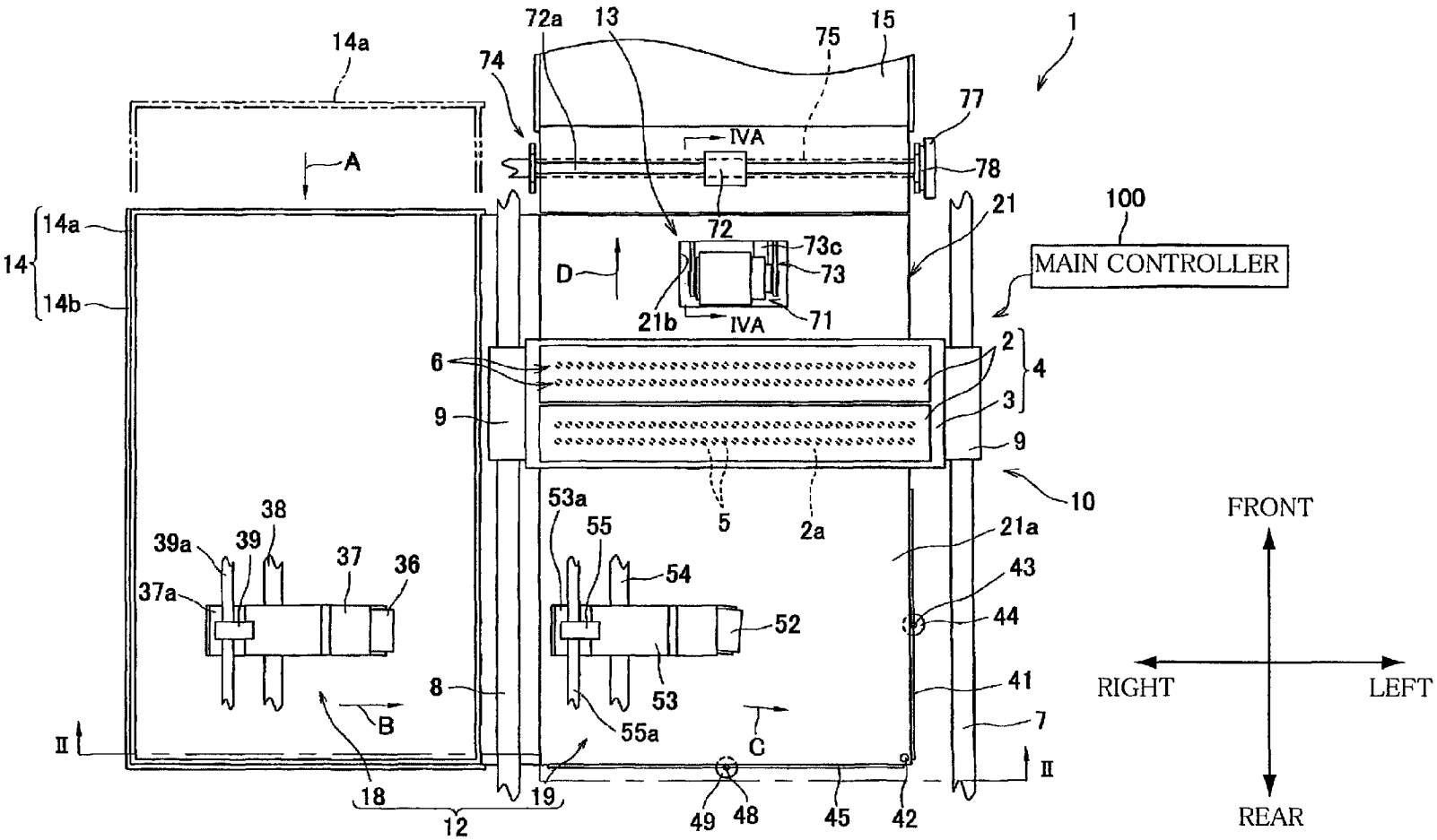
FIG. 1 is a plan view schematically showing an internal structure of an inkjet printer that is constructed according to an embodiment of the present invention.

As shown in FIG. 1, the inkjet printer 1 is a full color inkjet printer of line type equipped with two inkjet heads 2 each elongated in right and left directions of the inkjet printer 1.

The printer 1 includes an input sheet accommodator 14 as a first medium accommodator, a platen 21 as a medium supporter and an output sheet accommodator 15 as a second medium accommodator. The input sheet accommodator 14 is disposed in a right side portion of the printer 1, so as to accommodate a plurality of media sheets P as recording media. The platen 21 is disposed on a left side of the input sheet accommodator 14, and has an upper surface 21*a* as a flat horizontal surface. The output sheet accommodator 15 is disposed in a front side of the platen 21.

The printer 1 further includes a head mover 10, a sheet loading feeder 12 as a first medium feeder, a sheet unloading feeder 13 as a second medium feeder and a main controller 100. The head mover 10 is configured to move the inkjet heads 2 in forward and rearward directions of the printer 1. The sheet loading feeder 12 is configured to horizontally feed the media sheets P from the input sheet accommodator 14 onto the platen 21. The sheet unloading feeder 13 is configured to horizontally feed the media sheets P from the platen 21 to the output sheet accommodator 15. The operations of the head mover 10, the sheet loading feeder 12 and the sheet unloading feeder 13 are controlled by the main controller 100.

Figure 2:
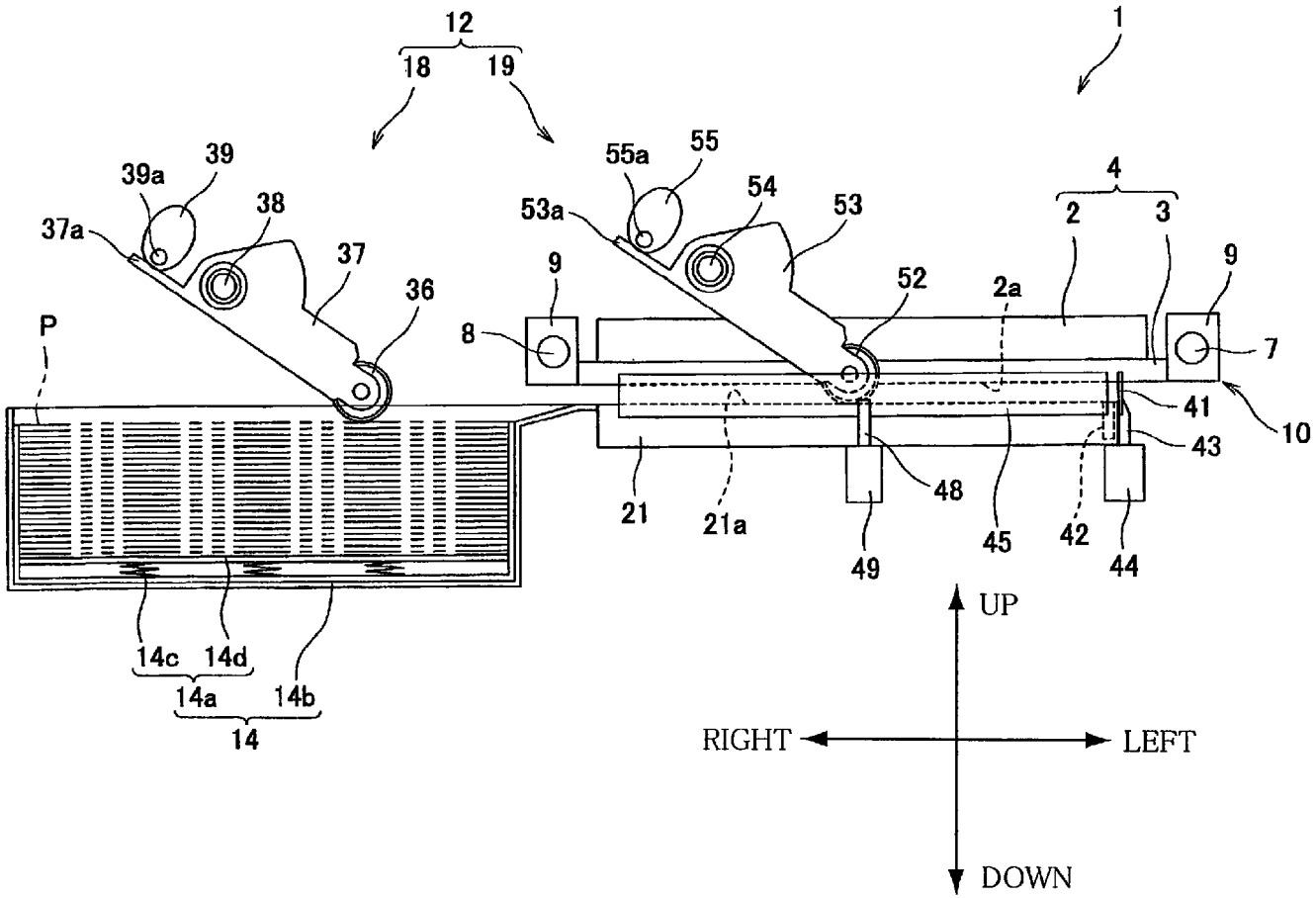
FIG. 2 is a cross sectional view taken along line II-II in FIG. 1.

The input sheet accommodator 14 has a box-like shaped tray 14*a* that opens upwardly and a tray holder 14*b* that holds the tray 14*a*, such that the tray 14*a* is slidable relative to the tray holder 14*b* in the forward and rearward directions. The tray 14*a* has an elongated rectangular shape as seen in a plan view, and is elongated in a direction in which the tray 14*a* is moveable relative to the tray holder 14*b*. In the tray 14*a*, the media sheets P are accommodated such that a longitudinal direction of each media sheet P in the direction in which the tray 14*a* is elongated. The tray 14*a* has a spring 14*c* and a bottom plate 14*d* that is upwardly biased by the spring 14*c*, as shown in FIG. 2, so that the media sheets P accommodated in the tray 14*a* are upwardly biased. When the media sheets P are to be accommodated in the input sheet accommodator 14, the tray 14*a* is forwardly drawn out of the tray holder 14*b*, and the media sheets P are set in the tray 14*a*. Then, the tray 14*a* is moved rearwardly in a medium introducing direction A to be introduced into the tray holder 14*b*. Thus, the input sheet accommodator 14 as the first medium accommodator is configured to receive the media sheets P introduced thereinto in the medium introducing direction A. The tray holder 14*b* has an medium introducing opening which faces an upstream side of the tray holder 14*b* in the medium introducing direction A and which allows introduction of the media sheets P into the tray holder 14*b* therethrough in the medium introducing direction A.

As shown in FIGS. 1 and 2, the sheet loading feeder 12 includes a first loader 18 and a second loader 19. The first loader 18 is configured to supply the media sheets P accommodated in the input sheet accommodator 14 toward in a leftward direction of the printer 1, i.e., a first medium loading direction B that is perpendicular to the medium introducing direction A. The second loader 19 is configured to feed the media sheets P supplied by the first loader 18, onto the platen 21.

The first loader 18 includes a pickup roller 36 as a first feed roller for picking up an uppermost one of the media sheets P accommodated in the input sheet accommodator 14, so as to supply the media sheets P one after another toward the platen 21. The first loader 18 further includes a pickup roller holder 37 as a first roller holder that rotatably holds the pickup roller 36, a drive shaft 38 that pivotably holds the pickup roller holder 37, a cam 39 as a first displacer that is configured to cause the pickup roller holder 37 to be pivoted about the drive shaft 38.

The pickup roller 36 is located in a position that is rearwardly deviated from a longitudinal center of the input sheet accommodator 14 (see FIG. 1). When the tray 14*a* is entirely introduced in the tray holder 14*b*, the pickup roller 36 is brought into contact with an uppermost one of the media sheets P accommodated in the input sheet accommodator 14. The pickup roller 36 is rotatable about a shaft that is parallel to the medium introducing direction A. The media sheets P are moved in the first medium loading direction B by rotation of the pickup roller 36.

The pickup roller 36 is rotatably held by one of opposite end portions of the pickup roller holder 37. The other of the opposite end portions of the pickup roller holder 37 provides a contact portion 37*a* that is held in contact with an outer circumferential surface of the cam 39. The cam 39 is fixed, at a portion close to its periphery, to a rotary shaft 39*a*, so that the cam 39 is rotated with rotation of the rotary shaft 39*a*. The pickup roller holder 37 has three gears (not shown) meshing with each other, one of which is fixed to the drive shaft 38 so as to be given a rotational force by the drive shaft 38, and the other two of which are arranged to transmit the rotational force to the pickup roller 36. That is, the drive shaft 38 cooperates with the three gears to constitute a first rotational force applier that is configured to apply the rotational force to the pickup roller 36 as the first feed roller such that the media sheets P are fed by rotation of the pickup roller 36.

In the first loader 18 constructed as described above, the pickup roller 36 is rotated in counterclockwise direction as seen in FIG. 2, when the drive shaft 38 is rotated in clockwise direction as seen in FIG. 2. In this instance, if the pickup roller 36 is held in contact with the media sheets P, an upper most one of the media sheets P is fed toward the platen 21 by the rotation of the pickup roller 36.

The second loader 19 includes a loading roller 52 as a second feed roller for loading the media sheets P picked up by the pickup roller 36, onto the upper surface 21*a* of the platen 21. The second loader 19 further includes a loading roller holder 53 as a second roller holder that rotatably holds the loading roller 52, a drive shaft 54 that pivotably holds the loading roller holder 53, a cam 55 as a second displacer that is configured to cause the loading roller holder 53 to be pivoted about the drive shaft 54.

The loading roller 52 is located in a position that is rearwardly deviated from a longitudinal center of the platen 21. The loading roller 52 is rotatable about a shaft that is slightly inclined with respect to the medium introducing direction A. The media sheets P are moved in a second medium loading direction C by rotation of the loading roller 52. The second medium loading direction C is parallel to neither the medium introducing direction A nor the first medium loading direction B. That is, the second medium loading direction C is inclined such that the media sheet P is forced rearwardly when being moved in a leftward direction of the printer 1 by the rotation of the loading roller 52, whereby the media sheet P is brought into contact with a stopper as a medium positioner that includes a longitudinally extending portion 41 as a first portion and a widthwise extending portion 45 as a second portion, so as to be reliably positioned in a predetermined position.

The loading roller 52 is rotatably held by one of opposite end portions of the loading roller holder 53. The other of the opposite end portions of the loading roller holder 53 provides a contact portion 53*a* that is held in contact with an outer circumferential surface of the cam 55. The cam 55 is fixed, at a portion close to its periphery, to a rotary shaft 55*a*, so that the cam 55 is rotated with rotation of the rotary shaft 55*a*. The loading roller holder 53 has three gears (not shown) meshing with each other, one of which is fixed to the drive shaft 54 so as to be given a rotational force by the drive shaft 54, and the other two of which are arranged to transmit the rotational force to the loading roller 52. That is, the drive shaft 54 cooperates with the three gears to constitute a second rotational force applier that is configured to apply the rotational force to the loading roller 52 as the second feed roller such that the media sheets P are fed by rotation of the loading roller 52.

In the second loader 19 constructed as described above, the loading roller 52 is rotated in counterclockwise direction as seen in FIG. 2, when the drive shaft 54 is rotated in clockwise direction as seen in FIG. 2. In this instance, if the loading roller 52 is held in contact with the media sheet P so as to cooperate with the upper surface 21*a* of the platen 21 to grip the media sheet P, the media sheet P is fed toward a left end of the platen 21 by the rotation of the loading roller 52.

Figure 3:
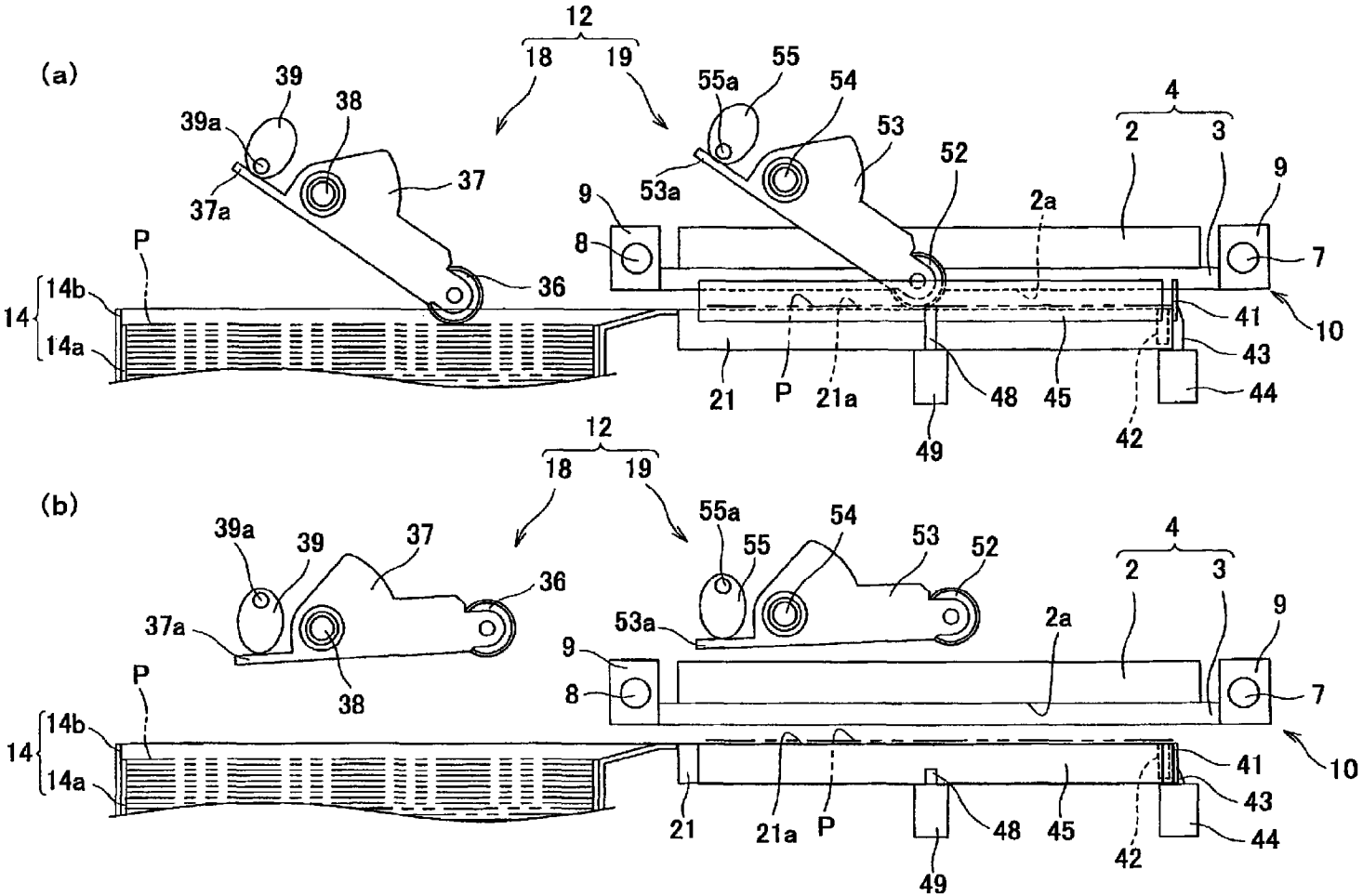
FIG. 3 is a set of views showing operations of first and second loaders of a sheet loading feeder of the inkjet printer of FIG. 1.

FIG. 3 is a set of views showing operations of first and second loaders 18, 19 of the sheet loading feeder 12. As shown in the views of FIG. 3, with the cams 39, 55 being rotated under control of the main controller 100, the pickup roller holder 37 and loading roller holder 53 are pivotable about the drive shafts 38, 54 in a direction that causes the contact portions 37*a*, 53*a* to be moved toward the rotary shafts 39*a*, 55*a* and in a direction that causes the contact portion 37*a*, 53*a* to be moved away from the rotary shafts 39*a*, 55*a*. When a distant between the contact portion 37*a* and the rotary shaft 39*a* is minimized, the pickup roller 36 held by the pickup roller holder 37 is placed in its contact position in which the roller 36 is in contact with an uppermost one of the media sheets P accommodated in the input sheet accommodator 14 (see view (a) of FIG. 3). Similarly, when a distant between the contact portion 53*a* and the rotary shaft 55*a* is minimized, the loading roller 52 held by the loading roller holder 53 is placed in its contact position in which the roller 53 is in contact with the media sheet P on the upper surface 21*a* of the platen 21 (see view (a) of FIG. 3).

On the other hand, when the distance between the contact portion 37*a* and the rotary shaft 39*a* is maximized, the pickup roller 36 held by the pickup roller holder 37 is placed in its distant position which is distant from the media sheets P accommodated in the input sheet accommodator 14 and which is higher than a height position of the inkjet heads 2 (see view (b) of FIG. 3). Similarly, when the distance between the contact portion 53*a* and the rotary shaft 55*a* is maximized, the loading roller 52 held by the loading roller holder 53 is placed in its distant position which is distant from the media sheet P and which is higher than the height position of the inkjet heads 2 (see view (b) of FIG. 3).

It is noted that the first loader 18 does not necessarily have to be located in a position higher than the inkjet heads 2 as long as the first loader 18 is located in a position higher than the tray 14*a* of the input sheet accommodator 14. With the loading roller 52 being placed in the distant position that is higher than the height position of the inkjet heads 2, as described above, horizontal movement of the inkjet heads 2 relative to the platen 21 is not impeded by the loading roller 52. That is, it is possible to avoid the inkjet heads 2 from being interfered by the loading roller 52.

The platen 21 has electrodes (not shown) built therein, so that the platen 21 is electrified with application of direct-current voltage between the electrodes, whereby an attraction force is applied between the upper surface 21*a* and the media sheet P that is placed on the upper surface 21*a*. The electrodes cooperates with a direct-current voltage generating circuit 108 (see FIG. 6) to constitute an attraction force applier that is configured to produce electrostatic charge for applying the attraction force between the upper surface 21*a* and the media sheet P. As shown in FIG. 1, the platen 21 has a rectangular shape, as seen in the plan view, which is elongated in a direction parallel to the above-described medium introducing direction A. The platen 21 has a length (as measured in the medium introducing direction A) that is substantially the same to that of the tray 14*a*. The platen 21 has a width (as measured in the first medium loading direction B) that is slightly larger than that of the tray 14*a*. In a left end portion and a rear end portion of the platen 21, the above-described longitudinally extending portion 41 and widthwise extending portion 45 of the stopper are provided, respectively, with which the media sheet P fed by the second loader 19 of the sheet loading feeder 12 are to be brought into contact. The media sheet P is positioned in the predetermined position by the stopper, with its leading end and lateral end (its left end and rear end) being brought into contact with the respective longitudinally extending portion 41 and widthwise extending portion 45 of the stopper.

The longitudinally extending portion 41 of the stopper is provided by an elongated plate member which is disposed in a left end portion of the platen 21 and extends from substantially a center of the left end portion to a rear end portion of the platen 21, as shown in FIG. 1. A piston 43 of a solenoid 44 is fixed to a central portion of the longitudinally extending portion 41. When the piston 43 is placed in its extending position, as shown in view (a) of FIG. 3, the longitudinally extending portion 41 of the stopper is placed in its projecting position, so as to project out from the upper surface 21*a* of the platen 21. The placement of the longitudinally extending portion 41 in the projecting position means that the same portion 41 is placed in its positioning state for positioning the media sheet P which is fed by the loading roller 52 in the second medium loading direction C which is brought into contact at is leading end with the same portion 41. On the other hand, when the piston 43 is placed in its retracted position, as shown in view (b) of FIG. 3, the longitudinally extending portion 41 of the stopper is placed in its non-projecting position, so as not to project out from the upper surface 21*a* of the platen 21. The placement of the longitudinally extending portion 41 in the non-projecting position means that the same portion 41 is placed in its non-positioning state for not impeding the movement of the inkjet heads 2. That is, during the placement of the longitudinally extending portion 41 in the non-positioning state, the inkjet heads 2 are not interfered by the same portion 41 of the stopper.

The widthwise extending portion 45 of the stopper is provided by an elongated plate member which is disposed in a rear end portion of the platen 21 and extends throughout substantially entirety of the rear end portion of the platen 21, as shown in FIG. 1. A piston 48 of a solenoid 49 is fixed to a central portion of the widthwise extending portion 45. When the piston 48 is placed in its extending position, as shown in view (a) of FIG. 3, the widthwise extending portion 45 of the stopper is placed in its projecting position, so as to project out from the upper surface 21*a* of the platen 21. The placement of the widthwise extending portion 45 in the projecting position means that the same portion 45 is placed in its positioning state for positioning the media sheet which is fed by the loading roller 52 in the second medium loading direction C which is brought into contact at its lateral end with the same portion 45. On the other hand, when the piston 48 is placed in its retracted position, as shown in view (b) of FIG. 3, the widthwise extending portion 45 of the stopper is placed in its non-projecting position, so as not to project out from the upper surface 21*a* of the platen 21. The placement of the widthwise extending portion 45 in the non-projecting position means that the same portion 45 is placed in its non-positioning state for not impeding the movement of the inkjet heads 2. That is, during the placement of the widthwise extending portion 45 in the non-positioning state, the inkjet heads 2 are not interfered by the same portion 45 of the stopper. Thus, each of the longitudinally and widthwise extending portions 41, 45 has a simple construction that establishes a selected one of its protruding and non-protruding positions and a selected one of the positioning and non-positioning states.

A sensor 42 as a detector is provided in a position which is close to ends of the respective longitudinally and widthwise extending portions 41, 45 of the stopper and which is an upstream side of the longitudinally extending portion 41 in the medium loading direction. Owing to the provision of the sensor 42, it is possible to determine whether the media sheet P fed by the loading roller 52 is actually positioned in the predetermined position by the stopper as the medium positioner. In this sense, the sensor 42 may be considered to constitute a determiner for determining whether the media sheet P is positioned in the predetermined position.

The platen 21 has a through-hole 21*b* that opens in the upper surface 21*a*, as shown in FIG. 1. The through-hole 21*b* is located in a position which is located in a widthwise center of the platen 21 and which is close to the output sheet accommodator 15. The through-hole 21 is a rectangular shape, as seen in the plan view of the printer 1, which is elongated in the widthwise direction of the platen 21. In the through-hole 21, there is provided a sheet unloading roller 71 of the sheet unloading feeder 13.

Figure 4A:
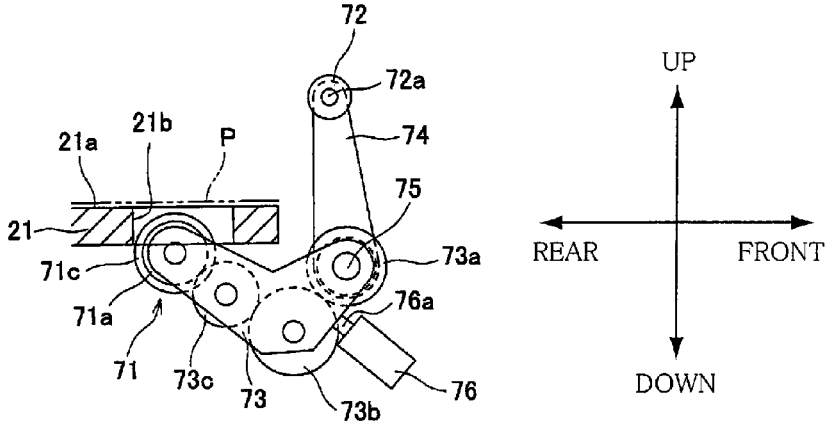
FIG. 4A is a cross sectional view showing a sheet unloading feeder and taken along line IVA-IVA in FIG. 1.
Figure 4B:
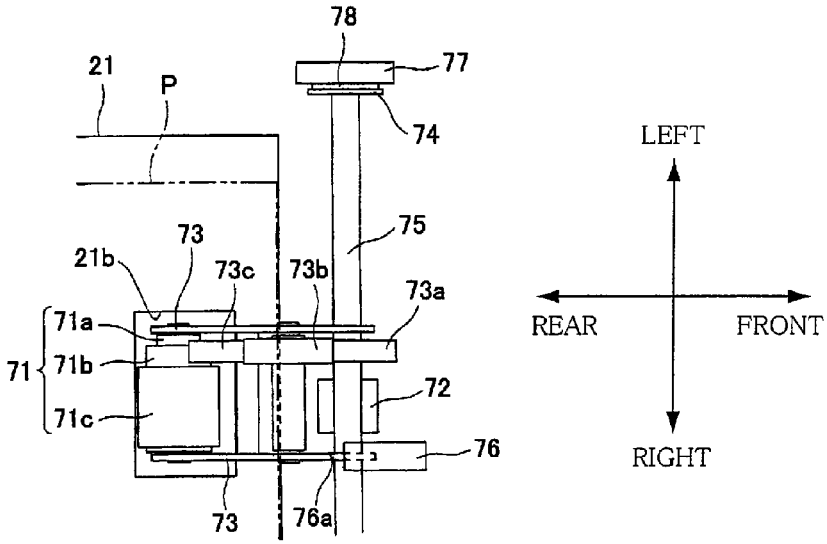
FIG. 4B is a view of the sheet unloading feeder as seen from its lower side.
Figure 5:
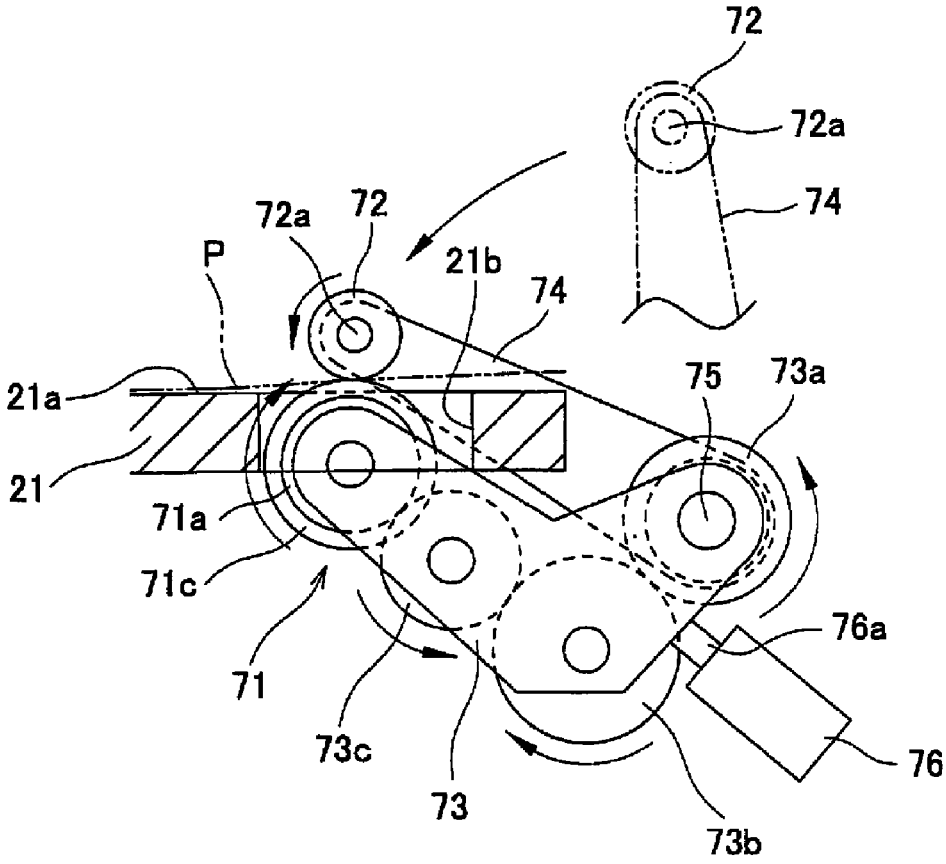
FIG. 5 is a view showing operation of the sheet unloading feeder for unloading a media sheet P.

FIG. 4A is a cross sectional view showing the sheet unloading feeder 13 and taken along line IVA-IVA in FIG. 1. FIG. 4B is a view of the sheet unloading feeder 13 as seen from its lower side. FIG. 5 is a view showing operation of the sheet unloading feeder 13 for unloading the media sheet P. As shown in FIGS. 4A and 4B, the sheet unloading feeder 13 includes: the above-described sheet unloading roller 71 aligned with the through-hole 21 of the platen 21; a nip roller 72 cooperating with the sheet unloading roller 71 to nip the media sheet P supported on the platen 21; a first roller holder 73 that rotatably holds the sheet unloading roller 71; a second roller holder 74 that rotatably holds the nip roller 72; a drive shaft 75 that pivotably holds the first and second roller holders 73, 74; a solenoid 76 configured to cause the first roller holder 73 to be pivoted about the drive shaft 75; a gear 77 is fixed to a left end portion of the drive shaft 75 as one of opposite end portions of the drive shaft 75; a friction member 78 fixed to a surface of the second roller holder 74 that is opposed to the gear 77. It is noted that each of the first and second roller holders 73, 74 is provided by two plate members. It is noted that the nip roller 72 may be provided by a rowel or spur.

As shown in FIG. 4B, the sheet unloading roller 71 includes: a cylindrical core portion 71*a* rotatably held at its axially opposite end portions by the respective two plate members of the first roller holder 73; a toothed portion (gear) 71*b* fixedly mounted on a part of the core portion 71*a* that is located on a left side of an axially central portion of the core portion 71*a*; and a frictional contact portion 71*c* mounted on another part of the core portion 71*a* that is provided by the axially central portion of the core portion 71*a* and also a portion located on a right side of the axially central portion of the core portion 71*a*. The toothed portion 71*b* and the frictional contact portion 71*a* are axially contiguous to each other.

In the present embodiment, the frictional contact portion 71*c* of the sheet unloading roller 71 is made of an elastic material such as rubber. However, the frictional contact portion 71*c* may be made of any other material, as long as the material enables transmission of the rotational force from the sheet unloading roller 71 to the media sheet P when the roller 71 is held in contact with the media sheet P. Further, where a large frictional force is generated between the frictional contact portion 71*c* and the media sheet P, the media sheet P can be moved to the output sheet accommodator 15 only by the rotational force of the sheet unloading roller 71, without the sheet unloading roller 71 cooperating with the nip roller 72 to nip the media sheet P.

In the first roller holder 73, three gears 73*a*, 73*b*, 73*c* are provided to mesh with each other. The gear 73*a* is fixed to the drive shaft 75, while the gears 73*b*, 73*c* are rotatably held by the first roller holder 73. The gear 73*c* meshes with the toothed portion 71*b* of the sheet unloading roller 71. With rotation of the drive shaft 75, a rotational force is given to the gear 73*a*, and then the rotational force is transmitted to the toothed portion 71*b* via the gears 73*b*, 73*c*, whereby the sheet unloading roller 71 is rotated.

Specifically described, when the drive shaft 75 is rotated in counterclockwise direction as shown in FIG. 5, the gear 73*a* is also rotated in the counterclockwise direction, and the gear 73*b* meshing with the gear 73*a* is rotated in clockwise direction. With rotation of the gear 73*b* in the clockwise direction, the gear 73*c* meshing with the gear 73*b* is rotated in the counterclockwise direction, and the toothed portion 71*b* meshing with the gear 73*c* is rotated in the clockwise direction. That is, with rotation of the drive shaft 75 in the counterclockwise direction, the sheet unloading roller 71 is rotated in the clockwise direction. In this instance, where the media sheet P is nipped between the sheet unloading roller 71 and the nip roller 72, the rotational force of the sheet unloading roller 71 is effectively transmitted to the media sheet P, whereby the media sheet P is fed in a medium unloading direction D (see FIG. 1) that is opposite to the medium introducing direction A, so as to be received by the output sheet accommodator 15. It is noted that, where the drive shaft 75 is rotated in the opposite direction, i.e., the clockwise direction, the sheet unloading roller 71 is rotated in the counterclockwise direction.

As shown in FIG. 4A, the solenoid 76 has a piston 76*a* that is fixed to one of the two plate members of the first roller holder 73. When the piston 76*a* is placed in its extending position, the first roller holder 73 is pivoted about the drive shaft 75 in clockwise direction, whereby the sheet unloading roller 71 is placed in its projecting position in which the roller 71 projects out from the upper surface 21*a* of the platen 21 through the through-hole 21*b*, as shown in FIG. 5. In this instance, if the media sheet P is supported on the upper surface 21*a* of the platen 21, a leading end portion of the media sheet P (i.e., one of longitudinally opposite end portions that is closer to the output sheet accommodator 15) is raised by the sheet unloading roller 71 so as to be separated from the upper surface 21*a*. On the other hand, when the piston 76*a* is placed in its retracted position, the first roller holder 73 is pivoted about the drive shaft 75 in counterclockwise direction, whereby the sheet unloading roller 71 is placed in its non-projecting position in which the roller 71 does not project out from the upper surface 21*a* of the platen 21, as shown in FIG. 4A.

The nip roller 72 is rotated about a center shaft 72*a* which extends in the direction of width of the platen 21 and which is rotatably held at its opposite end portions by the respective two plate members of the second roller holder 74. Like the first roller holder 73, the second roller holder 74 is rotatably held by the drive shaft 75 that extends in parallel to the center shaft 72*a*. That is, the first and second roller holders 73, 74 are pivotable about the drive shaft 75 as a common shaft, whereby the media sheet P can be nipped between the sheet unloading roller 71 and nip roller 72 in a position that is substantially constant. The friction member 78 is arranged to be contactable with a surface of the gear 77 that is opposed to the second roller holder 74. A rotational force is transmitted from the gear 77 to the second roller holder 74 through the friction member 78, while a resistance acting against pivot movement of the second roller holder 74 is not larger than a predetermined threshold. Specifically described, when the gear 77 is rotated in counterclockwise direction, the second roller holder 74 is pivoted in the in counterclockwise direction, as shown in FIG. 5, owing to contact of the friction member 78 with the gear 77. In this instance, where the sheet unloading roller 71 is placed in the projecting position so as to project out from the upper surface 21*a* of the platen 21, the leading end portion of the media sheet P separated from the upper surface 21*a* is nipped by the sheet unloading roller 71 and the nip roller 72. With rotation of the sheet unloading roller 71 in the clockwise direction, the rotational force is effectively transmitted from the sheet unloading roller 71 to the media sheet P, owing to cooperation of the sheet unloading roller 71 and nip roller 72 for nipping the media sheet P therebetween, for thereby making it possible to stably feeding the media sheet P. Where the resistance acting against pivot movement of the second roller holder 74 is larger than the predetermined threshold, due to nipping of the media sheet P between the two rollers 71, 72, the rotational force is not transmitted between the gear 77 and the second roller holder 74, so that each of the gear 77 and the second roller holder 74 is rotated relative to the other of the gear 77 and the second roller holder 74. That is, the drive shaft 75 and the gear 77 are loosely rotated relative to the second roller holder 74 and the friction member 78.

It is noted that the nip roller 72 is rotated together with feed movement of the media sheet P since the nip roller 72 is arranged to be freely rotatable. That is, the nip roller 72 is rotated by its contact with the media sheet P that is fed by rotation of the sheet unloading roller 71. On the other hand, when the gear 77 is rotated in the opposite direction, i.e., the clockwise direction, the second roller holder 74 is pivoted in the clockwise direction whereby the nip roller 72 is displaced to its non-nipping position, as shown in FIG. 4A, for thereby releasing nipping of the media sheet P by the nip roller 72 and the sheet unloading roller 71.

Referring back to FIG. 1, there will be described construction of the inkjet heads 2 in detail. As shown in FIG. 1, each of the two inkjet heads 2 has a rectangular shape, as seen in the plan view, which is elongated in the width direction of the platen 21 (i.e., direction perpendicular to the medium introducing direction A). The two inkjet heads 2 are arranged in the longitudinal direction of the platen 21, and are fixed to a frame 3, so that the two inkjet heads 2 cooperate with the frame 3 to constitute a head unit 4 that is elongated in the width direction of the platen 21. Each of the inkjet heads 2 has a nozzle opening surface 2*a* that is opposed to the upper surface 21*a* of the platen 21. A plurality of nozzles 5 open in the nozzle opening surface 2*a*, are arranged in two rows 6 each extending in the width direction of the platen 21.

As shown in FIG. 1, the plurality of nozzles 5 forming each of the two rows 6 are arranged in the width direction of the platen 21 at a constant spacing pitch that corresponds to a required degree of resolution. Two of the nozzles 5, which are located in respective opposite ends of each of the two rows 6, are located in respective positions that are slightly outside widthwise opposite ends of the media sheet P, whereby a marginless printing can be performed on the media sheet P.

Further, a permissible tolerance in positioning of the media sheet P relative to the platen 21 can be increased by the above-described arrangement in which the opposite end nozzles 5 of each row 2 are located in the respective positions that are outside the media sheet P rather than being opposed to the media sheet P. This is because, even if the media sheet P is somewhat deviated from a desired position defined by the longitudinally extending portion 41 of the stopper in the width direction of the platen 21, the nozzles 5 are present in positions opposed to the widthwise opposite ends of the media sheet P.

In the present embodiment, four color inks (e.g., magenta, cyan, yellow and black inks) are ejected through the plurality of nozzles 5. The magenta ink is ejected through the nozzles 5 forming the frontmost one of the rows 6 (i.e., the uppermost one of the rows 6 as seen in FIG. 1), the cyan ink is ejected through the nozzles 5 forming the second frontmost one of the rows 6, the yellow ink is ejected through the nozzles 5 forming the second rearmost one of the rows 6, and the black ink is ejected through the nozzles 5 forming the rearmost one of the rows 6.

The above-described degree of resolution corresponding to the nozzle spacing pitch in the inkjet heads 2 is precisely determined by a distance between each adjacent pair of points at which a widthwise extending line (not shown) extending in the width direction of the platen 21 intersects with a plurality of longitudinally extending lines (not shown) perpendicular to the widthwise extending line and passing through centers of the respective nozzles 5. In the present embodiment, the nozzles 5 forming each of the rows 6 are assigned to eject therethrough a corresponding one of the four color inks, and arranged straight in parallel to the width direction of the platen 21, so that the degree of resolution is determined by the nozzle spacing pitch between the nozzles 5 as measured in the width direction of the platen 21 in which the rows 6 extend.

The head mover 10 includes a pair of rails 7, 8 and a pair of linear motors 9. The rails 7, 8 are disposed on respective opposite sides of the head unit 4 in the longitudinal direction of the head unit 4, and extend in the width direction of the head unit 4 (i.e., the longitudinal direction of the platen 21). Each of the linear motors 9, which are fixed to the frame 3 of the head unit 4, is disposed on a corresponding one of the rails 7, 8, so as to be movable on the corresponding one of the rails 7, 8. With movements of the linear motors 9 along the respective rails 7, 8 under control of the main controller 100, the head unit 4 (i.e., two inkjet heads 2) are moved relative to the platen 21 in the longitudinal direction of the platen 21 that is parallel to the medium introducing direction A and medium unloading direction D.

The main controller 100 will be described with reference to FIG. 6 that is a functional block diagram of the main controller 1. The main controller 100 incorporates therein: a CPU (central processing unit); a ROM (read only memory) storing control programs executed by the CPU and data used in execution of the control programs; a RAM for temporarily storing data in the execution of the control programs; and other logic circuits. With integral performances of these incorporated elements, there are established functional portions as described below.

Figure 6:
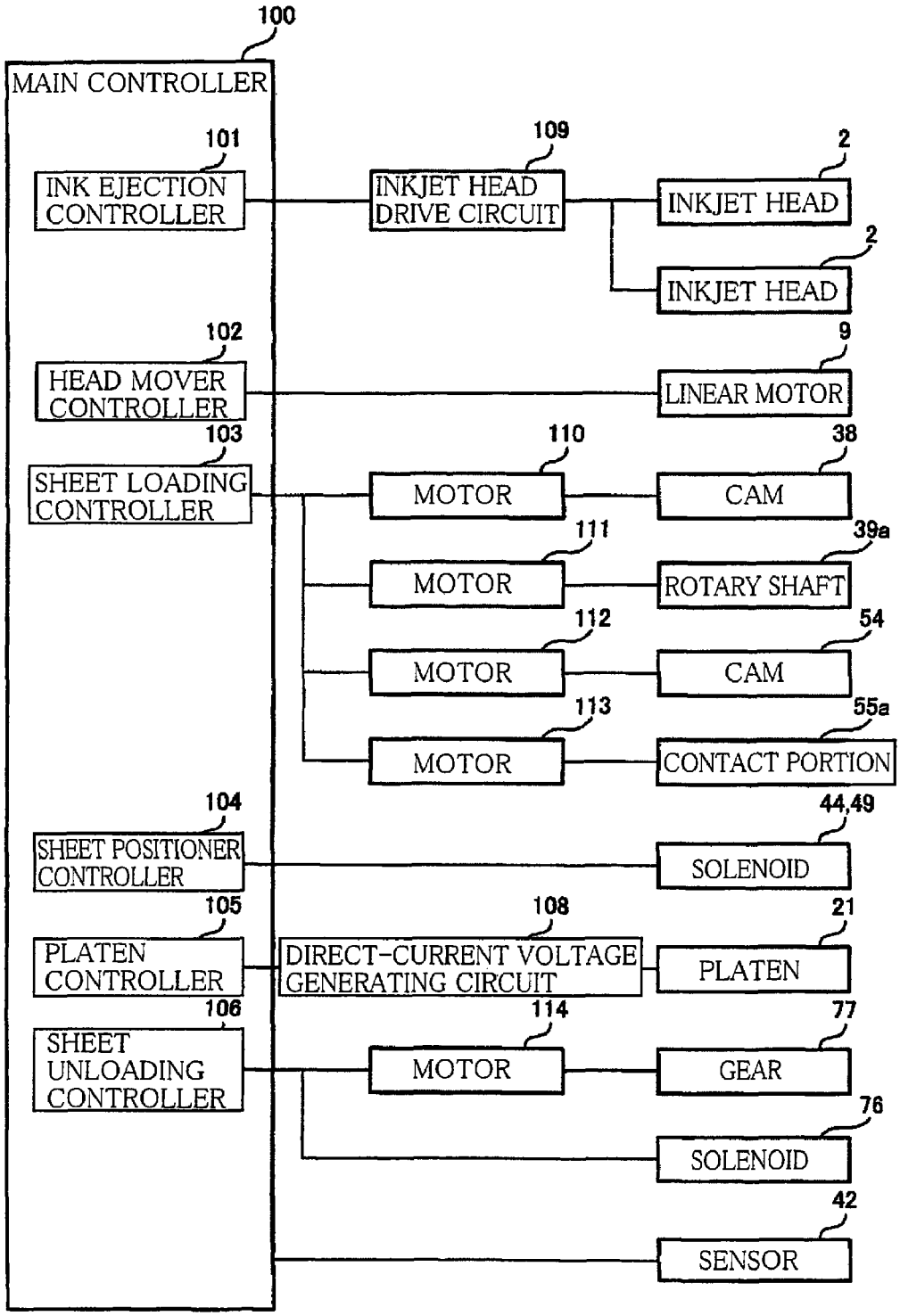
FIG. 6 is a functional block diagram of a main controller of the inkjet printer of FIG. 1.

As shown in FIG. 6, the main controller 100 includes the functional portions in the form of: an ink ejection controller 101; a head mover controller 102; a sheet loading controller 103 as a first feeder controller; a sheet positioner controller 104; a platen controller 105; and a sheet unloading controller 106 as a second feeder controller. The above-described sensor 42 disposed on the platen 21 is connected to the main controller 100, so as to detect the media sheet P positioned in the predetermined position on the upper surface 21*a* of the platen 21, for determining whether the media sheet P fed by the loading roller 52 is actually positioned in the predetermined position by the stopper as the medium positioner.

The ink ejection controller 101 is configured to control an inkjet head drive circuit 109, based on data indicative of desired image and received by the main controller 100, so as to cause the ink to be ejected through the nozzles 5 of the inkjet heads 2. The inkjet head drive circuit 109 generates signals commanding ejection of the ink, based on command supplied from the ink ejection controller 101, and the generated signals are supplied to a plurality of actuators (not shown) provided in the inkjet heads 2. Upon supply of the signals thereto, the actuators are operated to apply pressures to the ink within the inkjet heads 2, for thereby causing the pressurized ink is ejected through the nozzles 5. The ink is thus ejected from the inkjet heads 2.

The head mover controller 102 is configured to control operations of the respective linear motors 9 of the head mover 10, so as to cause the linear motors 9 to be moved along the respective rails 7, 8. The sheet loading controller 103 is configured to control operations of respective four motors 110, 111, 112, 113. The motor 110 is operated to rotate the drive shaft 38 of the first loader 18. The motor 111 is operated to rotate the rotary shaft 39*a* of the cam 39 of the first loader 18. The motor 112 is operated to rotate the drive shaft 54 of the second loader 19. The motor 113 is operated to rotate the rotary shaft 55*a* of the cam 55 of the second loader 19. With the operations of the motors 110, 111, 112, 113 under control of the sheet loading controller 103, the media sheet P is loaded onto the upper surface 21*a* of the platen 21 from the input sheet accommodator 14.

The sheet positioner controller 104 is configured to control operation of each of the respective solenoids 44, 49 so as to cause a corresponding one of the longitudinally and widthwise extending portions 41, 45 of the stopper to be placed in a selected one of the projecting position (in which it projects out from the upper surface 21*a* of the platen 21) and the non-projecting position (in which it does not project from the upper surface 21*a* of the platen 21). The platen controller 105 is configured to control the direct-current voltage generating circuit 108 that is provided for applying direct-current voltage between the electrodes disposed in the platen 21, so as to selectively cause the platen 21 to hold the media sheet P (that has been fed onto the upper surface 21*a* of the platen 21) and release the holding of the media sheet P by the platen 21.

The sheet unloading controller 106 is configured to control operation of the solenoid 76 so as to cause the sheet unloading roller 71 to be placed in a selected one of the projecting position (in which it projects out from the upper surface 21*a* of the platen 21) and the non-projecting position (in which it does not project from the upper surface 21*a* of the platen 21), and also to control operation of a motor 114 for rotating the gear 77 so as to cause the nip roller 72 to be displaced between the above-described nipping and non-nipping position. Since the gear 77 and the drive shaft 75 are fixed to each other, the drive shaft 75 is rotated with rotation of the gear 77, whereby the sheet unloading roller 71 is rotated. While the media sheet P is being nipped between the sheet unloading roller 71 and nip roller 72, the media sheet P (supported on the upper surface 21*a* of the platen 21) is unloaded to the output sheet accommodator 15, by rotation of the sheet unloading roller 71 in the clockwise direction (as seen in FIG. 4A).

Figure 7:
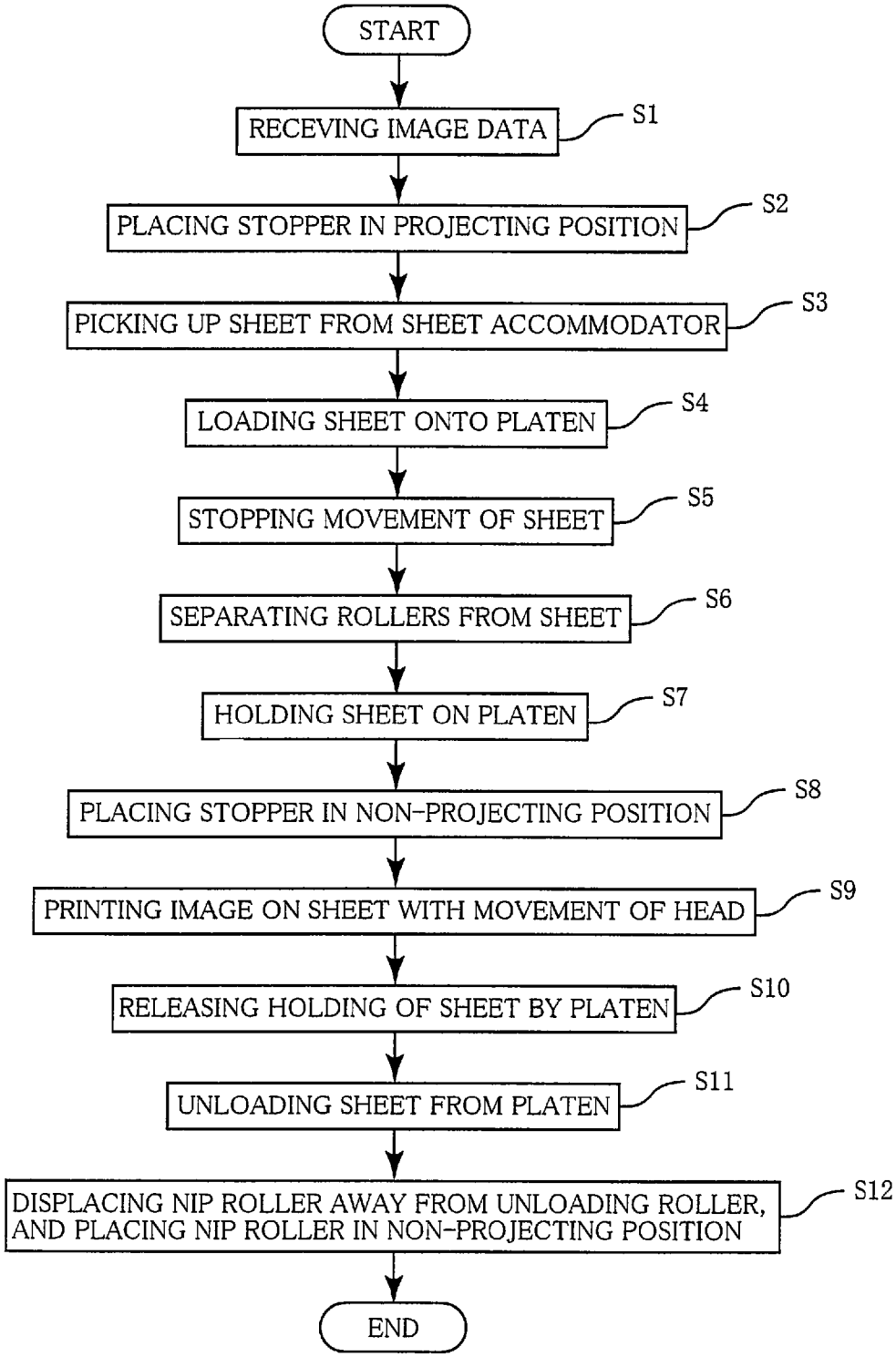
FIG. 7 is a flow chart showing a controlling routine program that is executed in the inkjet printer of FIG. 1.

FIG. 7 is a flow chart showing a controlling routine program that is executed in the inkjet printer 1 upon a printing operation for printing an image on the media sheet P. The routine program is initiated with step S1 in which the main controller 100 receives data indicative of image that is to be formed on one media sheet P. Step S1 is followed by step S2 in which the sheet positioner controller 104 controls operations of the solenoids 44, 49 so as to cause the longitudinally and widthwise extending portions 41, 45 of the stopper to be placed in the respective projecting positions.

Then, in step S3, the sheet loading controller 103 controls operation of the motor 111 so as to cause the cam 39 to be positioned in an angular position, as shown in view (a) of FIG. 3, which causes the pickup roller 36 to be brought into contact with an uppermost one of the media sheets P accommodated in the input sheet accommodator 14. The motor 111 is stopped by the sheet loading controller 103 when the cam 39 is positioned in the angular position that causes the pickup roller 36 to be brought into contact with the uppermost media sheet P. Then, the sheet loading controller 103 controls operation of the motor 110 so as to cause the pickup roller 36 to be rotated for picking up the uppermost media sheet P (with which the pickup roller 36 is held in contact) from the input sheet accommodator 14 and moving the uppermost media sheet P toward the platen 21.

Step S3 is followed by step S4 in which the sheet loading controller 103 controls operation of the motor 113 so as to cause the cam 55 to be positioned in an angular position, as shown in view (a) of FIG. 3, which causes the loading roller 52 to be brought into contact with the media sheet P reaching the upper surface 21*a* of the platen 21. The motor 113 is stopped by the sheet loading controller 103 when the cam 55 is positioned in the angular position that causes the loading roller 52 to be brought into contact with the media sheet P. Then, the sheet loading controller 103 controls operation of the motor 112 so as to cause the loading roller 52 to be rotated for moving the media sheet P (with which the loading roller 52 is held in contact) and bringing the media sheet P into contact with the longitudinally and widthwise extending portions 41, 45 of the stopper.

Next, in step S5, upon detection of the leading end of the media sheet P by the sensor 42 when the leading end and side end of the media sheet P are brought into contact with the longitudinally extending portion 41 widthwise extending portion 45 of the stopper, respectively, the motors 110, 112 are stopped by the sheet loading controller 103 for stopping feed movement of the media sheet P. Owing to this control arrangement, the media sheet P can be positioned substantially in a constant position as the predetermined position, thereby making it possible to improve accuracy of printing performed by the inkjet heads 2. Further, since the media sheet P is positioned by its contact with two portions of the stopper, i.e., the longitudinally and widthwise extending portions 41, 45 of the stopper, it is possible to improve accuracy of positioning of the media sheet P on the upper surface 21*a*. Further, since the sensor 42 is disposed in a position which is close to both of the longitudinally and widthwise extending portions 41, 45 of the stopper and which is located on an upstream side of the longitudinally extending portion 41 of the stopper, the media sheet P can be reliably positioned in the predetermined position on the upper surface 21*a*.

Step S5 is followed by step S6 in which the sheet loading controller 103 controls operations of the motors 111, 113 so as to cause the cams 39, 55 to be positioned in respective angular positions, as shown in view (b) of FIG. 3, which cause the pickup roller 36 and loading roller 52 to be displaced in respective positions that are higher than height of the head unit 4, as shown in view (b) of FIG. 3. The motors 111, 113 are stopped by the sheet loading controller 103 when the cams 39, 55 are positioned in the angular positions that cause the rollers 36, 52 to be displaced in the positions above the head unit 4. It is noted that, where the next media sheet P as a new uppermost media sheet P is to be subsequently loaded to the platen 21, step S6 may be implemented with the pickup roller 36 being held in contact with the uppermost media sheet P accommodated in the input sheet accommodator 14, rather than with the pickup roller 36 being displaced away from the media sheet P, so that the new uppermost media sheet P can be moved toward the platen 21 immediately after the preceding media sheet P has been subjected to a printing operation and unloaded from the platen 21.

Next, in step S7, the platen controller 105 controls the direct-current voltage generating circuit 108 so as to cause the platen 21 to be electrified for applying the attraction force between the media sheet P and the upper surface 21*a* of the platen 21. Owing to this control arrangement, the media sheet P positioned by the longitudinally and widthwise extending portions 41, 45 of the stopper can be reliably held in the predetermined position during the printing operation.

Step S7 is followed by step S8 in which the sheet positioner controller 104 controls operations of the solenoids 44, 49 so as to cause the longitudinally and widthwise extending portions 41, 45 of the stopper to be placed into the respective non-projecting positions. With the two extending portions 41, 45 of the stopper being placed in the non-projecting positions, it is possible to avoid the inkjet heads 2 from being interfered by the stopper during movement of the inkjet heads 2 relative to the platen 21.

Next, in step S9, the head mover controller 102 controls operations of the linear motors 9 so as to cause the head unit 4 to be reciprocatively moved in parallel to the longitudinal direction of the platen 21, in a direction away from a rear side of the printer 1 toward a front side of the printer 1 and a direction away from the front side to the rear side. In this instance, while the nozzle opening surfaces 2*a* of the inkjet heads 2 are opposed to the media sheet P, the ink ejection controller 101 controls the inkjet head drive circuit 109 so as to cause the ink to be ejected through the nozzles 5 toward the media sheet P for thereby forming a desired image with a predetermined degree of resolution. Then, when the reciprocative movement of the head unit 4 is completed, the operations of the linear motors 9 are stopped by the head mover controller 102.

Step S9 is followed by step S10 in which the platen controller 105 controls the direct-current voltage generating circuit 108 so as to stop the electrification of the platen 21, for releasing the holding of the media sheet P by the platen 21.

Next, in step S11, the sheet unloading controller 106 controls operation of the solenoid 76 so as to cause the sheet unloading roller 71 to be placed in the projecting position in which the roller 71 projects out from the upper surface 21*a* of the platen 21, as shown in FIG. 5. In this instance, the leading end portion of the media sheet P as one of its longitudinally opposite end portions is upwardly pressed by the sheet unloading roller 71, as shown in FIG. 5. Then, the motor 114 is rotated by the sheet unloading controller 106, so as to cause the gear 77 to be rotated in the counterclockwise direction as seen in FIG. 5 and accordingly cause the sheet unloading roller 71 to be rotated in the clockwise direction as seen in FIG. 5. In this instance, the second roller holder 74 is pivoted in the counterclockwise direction as seen in FIG. 5, since the friction member 78 is held in contact with the rotated gear 77. Thus, the nip roller 72 to be displaced to its nipping position for cooperating with the sheet unloading roller 71 to nip the media sheet P. The rotational force is applied from the sheet unloading roller 71 to the media sheet P nipped between the two rollers 71, 72, whereby the media sheet P is unloaded from the platen 21 to the output sheet accommodator 15.

Then, step S12 is implemented, after the media sheet P has being moved to the output sheet accommodator 15, the sheet unloading controller 106 inverts direction of the rotation of the motor 114, so as to cause the nip roller 72 to be displaced away from the sheet unloading roller 71 and to be placed in a position that overlaps the drive shaft 75 as seen in the plan view of FIG. 1. Then, the sheet unloading controller 106 stops the rotation of the motor 114, and controls operation of the solenoid 76 so as to cause the sheet unloading roller 71 to be displaced to the non-projecting position in which the roller 71 does not project out from the upper surface 21*a* of the platen 21, as shown in FIG. 4A. Thus, the sheet unloading roller 71 is placed in the non-projecting position except when the media sheet P is to be unloaded to the output sheet accommodator 15, so that the sheet unloading roller 71 does not interfere with the inkjet heads 2 while the inkjet heads 2 are operated to perform the printing operation onto the media sheet P. One cycle of execution of the controlling routine program of FIG. 7 is completed with step S12, whereby the printing operation has been performed onto the media sheet P.

In the inkjet printer 1 constructed as described above, when the printing operation is performed onto the media sheet P, the media sheet P is fed by the first loader 18 of the sheet loading feeder 12 from the input sheet accommodator 14 in the first medium loading direction B that is perpendicular to the medium introducing direction A, and then the media sheet P fed by the first loader 18 of the sheet loading feeder 12 is fed by the second loader 19 of the sheet loading feeder 12 in the second medium loading direction C that intersects the medium introducing direction A. After the image has been formed on the media sheet P, the media sheet P is fed by the sheet unloading feeder 13 in the medium unloading direction D that is opposite to the medium introducing direction A so as to be unloaded. Therefore, from its introduction into the input sheet accommodator 14 until its unloading from the platen 21 toward the output sheet accommodator 15, the media sheet P is moved along a movement path that has a letter U shape as seen in the plan view of the printer 1 (see FIG. 1). Since the media sheet P substantially maintains its horizontal posture throughout the feed movement, the media sheet P can be fed along the movement path without the media sheet P being curled even where the media sheet P is provided by a relatively rigid sheet such as post card or business card. Further, the medium unloading direction D (in which the media sheet P is unloaded from the platen 21 toward the output sheet accommodator 15) is opposite to the medium introducing direction A (in which the tray 14*a* is introduced into the tray holder 14*b*), the introduction of the media sheet P into the input sheet accommodator 14 and the taking of the media sheet P out of the output sheet accommodator 15 can be made from the front side of the inkjet printer 1. Thus, this arrangement facilitates a user to introduce the media sheet P into the printer 1 and to take the media sheet P out of the printer 1.

Further, since the inkjet heads 2 are elongated in the width direction of the platen 21 (i.e., direction perpendicular to the medium introducing direction A), it is possible to reduce a size of the printer 1 as measured in the longitudinal direction of the platen 21. The reduction in this size of the printer 1 leads to reduction in a depth of the printer 1 as measured from the front side from which the introduction of the media sheet P into the input sheet accommodator 14 and the taking of the media sheet P out of the output sheet accommodator 15 are made by the user.

Further, since the longitudinal direction of the upper surface 21*a* of the platen 21 and the longitudinal direction of the media sheet P both coincide with the medium introducing direction A, it is possible to reduce a size of the printer 1 as measured in a direction perpendicular to the medium introducing direction A. Consequently, the printer 1 can be made compact as a whole.

While the preferred embodiment of this invention has been described above, it is to be understood that the invention is not limited to the details of the illustrated embodiment, but may be embodied with various changes and modifications, which may occur to those skilled in the art, without departing from the sprit and scope of the present invention.

For example, in the above described embodiment, two of the nozzles 5, which are located in the respective opposite ends of each of the two rows 6, are located in the respective positions that are slightly outside the widthwise opposite ends of the media sheet P. However, if the printer 1 is not required to perform a marginless printing, it is not necessary to provide the nozzles 5 that are located in the respective positions that are outside the widthwise opposite ends of the media sheet P.

Further, the cams 39, 55 of the sheet loading feeder 12 are not essential as long as the sheet loading feeder 12 has a construction enabling the media sheet P to be loaded onto the upper surface 21*a* of the platen 21. Further, the inkjet heads 2 may be elongated in the longitudinal direction of the platen 21. In this modified arrangement, since the nozzle opening surfaces 2*a* are elongated also in the longitudinal direction of the platen 21, it is preferable that the nozzles 5 are arranged in rows extending in the longitudinal direction of the platen 21.

Further, the head mover 10 may be configured to move the head unit 4 in the width direction of the platen 21. Further, the platen 21 may be elongated in the direction perpendicular to the medium introducing direction A. In this modified arrangement, it is preferable that the tray 14*a* is elongated in the same direction perpendicular to the medium introducing direction A. Further, the stopper (provided by the longitudinally and widthwise extending portions 41, 45) is not essential. Where the stopper is not provided, the sheet positioner controller 104 may not be provided, either. Further, the medium positioner for positioning the media sheet P in the position on the plate 21 may be provided by an element or elements other than the stopper. Further, the sensor 42 may not be provided.

Further, like the shaft about which the loading roller 52 of the second loader 19 is rotatable, the shaft about which the pickup roller 36 of the first loader 18 is rotatable may be slightly inclined with respect to the medium introducing direction A. Further, in the above-described embodiment, the attraction force applier is provided by the direct-current voltage generating circuit 108 so that the media sheet P is electrostatically held down on the platen 21 that is electrified. However, the attraction force applier is not particularly limited, but may be provided by other kind of device such as a negative pressure applier that is arranged to apply a negative pressure as the attraction force, for example, via through-holes opening in the upper surface 21*a* of the platen 21.

Further, in the above-described embodiment, the medium introducing direction A (in which the media sheet P is introduced into the input sheet accommodator 14) is opposite to the medium unloading direction D (in which the media sheet P is unloaded from the platen 21 to the output sheet accommodator 15). However, the input sheet accommodator 14 may be configured such that the medium introducing direction A substantially coincides with the first and second medium loading directions B, C (in which the media sheet P is fed from the input sheet accommodator 14 toward the platen 21) that are substantially perpendicular to the medium unloading direction D. In this modified arrangement, too, introduction of the media sheet P into the input sheet accommodator 14 and taking of the media sheet P out of the output sheet accommodator 15 can be made easily by an user, even where the inkjet printer 1 is installed in a corner portion of a room that is defined by walls intersecting with each other, for example, at about 90°. In this case, the inkjet printer 1 can be installed such that the directions A, B, C are substantially directed toward one of the intersecting walls while the direction D is substantially directed away from the other of the intersecting walls.

What is claimed is:

1. An inkjet recording apparatus comprising:

a first medium accommodator configured to accommodate a recording medium;

a medium supporter having a flat horizontal surface on which the recording medium is to be supported;

an inkjet head having a nozzle opening surface that is opposed to said flat horizontal surface of said medium supporter;

a first medium feeder configured to horizontally feed the recording medium accommodated in said first medium accommodator, in a single medium loading direction, such that the recording medium is fed onto said flat horizontal surface of said medium supporter;

a second medium feeder configured to horizontally feed the recording medium supported on said flat horizontal surface of said medium supporter, in a single medium unloading direction that is substantially perpendicular to the single medium loading direction in a plan view as seen in a direction perpendicular to said flat horizontal surface of said medium supporter; and a second medium accommodator configured to accommodate the recording medium that is fed in the medium unloading direction by said second medium feeder.

2. The inkjet recording apparatus according to claim 1, wherein said first medium accommodator is configured to receive the recording medium introduced thereinto in a medium introducing direction that is opposite to the single medium unloading direction.

3. The inkjet recording apparatus according to claim 2, wherein said first medium accommodator has a medium introducing opening which faces an upstream side of said first medium accommodator in the medium introducing direction and which allows introduction of the recording medium into said first medium accommodator therethrough in the medium introducing direction, and wherein said second medium accommodator is disposed on a downstream side of said medium supporter in the single medium unloading direction.

4. The inkjet recording apparatus according to claim 2, further comprising:

a head mover configured to move said inkjet head relative to said medium supporter in parallel or perpendicular to the medium introducing direction;

a first feeder controller configured to control said first medium feeder, for causing the recording medium to be fed by said first medium feeder from the first medium accommodator onto said flat horizontal surface of said medium supporter;

a head mover controller configured to control said head mover, for causing said inkjet head to be moved by said head mover;

an ink ejection controller configured to control said inkjet head, for causing ink to be ejected, during movement of said inkjet head, through nozzles opening in said nozzle opening surface, toward the recording medium supported on said flat horizontal surface of said medium supporter; and a second feeder controller configured to control said second medium feeder, for causing the recording medium to be fed by said second medium feeder from said flat horizontal surface toward said second medium accommodator.

5. The inkjet recording apparatus according to claim 4, wherein said nozzle opening surface of said inkjet head is a rectangular surface elongated in a longitudinal direction which is parallel to said flat horizontal surface of said medium supporter and which is perpendicular to the medium introducing direction, wherein said inkjet head has a plurality of nozzles which open in said nozzle opening surface and which are arranged in at least one row parallel to the longitudinal direction, and wherein said head mover is configured to move said inkjet head in parallel to the medium introducing direction.

6. The inkjet recording apparatus according to claim 5, wherein said flat horizontal surface of said medium supporter is a rectangular surface elongated in the medium introducing direction, and wherein said first medium accommodator is configured to receive the recording medium that is elongated in the medium introducing direction.

7. The inkjet recording apparatus according to claim 1, further comprising:

a feeder controller configured to control said first medium feeder, for causing the recording medium to be fed by said first medium feeder from said first medium accommodator onto said flat horizontal surface of said medium supporter;

a medium positioner configured to be selectively placed in one of positioning and non-positioning states, such that the recording medium fed onto said flat horizontal surface is positioned in a predetermined position relative to said flat horizontal surface when said medium positioner is placed in the positioning state;

a positioner controller configured to control said medium positioner, for placing said medium positioner in a selected one of the positioning and non-positioning states; and a determiner configured, when said medium positioner is placed in the positioning state, to determine whether the recording medium is positioned in the predetermined position, wherein said feed controller is configured to control said first medium feeder to stop feeding the recording medium, when said determiner determines that the recording medium is positioned in the predetermined position.

8. The inkjet recording apparatus according to claim 7, wherein said medium positioner includes a stopper that is configured to be placed in a projecting position during placement of said medium positioner in the positioning state and to be placed in a non-projecting position during placement of said medium positioner in the non-positioning state, such that said stopper projects out from said flat horizontal surface of said medium supporter toward said nozzle opening surface of said inkjet head when said stopper is placed in the projecting position, and such that said stopper does not project out from said flat horizontal surface when said stopper is placed in the non-projecting position, and wherein said stopper is configured to position the recording medium that is brought into contact at an end portion thereof with said stopper when said stopper is placed in the projecting position.

9. The inkjet recording apparatus according to claim 8, wherein said stopper includes a first portion and a second portion that are disposed in a widthwise end portion and a longitudinal end portion of said flat horizontal surface of said medium supporter, respectively, wherein said first portion of said stopper defines a first contact surface intersecting with a direction of width of said flat horizontal surface, whereby positioning of the recording medium relative to said flat horizontal surface in the direction of width of said flat horizontal surface is assured by contact of the recording medium with said first contact surface, and wherein said second portion of said stopper defines a second contact surface intersecting with a direction of length of said flat horizontal surface, whereby positioning of the recording medium relative to said flat horizontal surface in the direction of length of said flat horizontal surface is assured by contact of the recording medium with said second contact surface.

10. The inkjet recording apparatus according to claim 8, wherein said determiner includes a detector disposed in a detecting position which is located in vicinity of said stopper, so as to detect presence of said end portion of the recording medium in the detecting position, and wherein said determiner is configured to determine that the recording medium is positioned in the predetermined position, when said detector detects the presence of said end portion of the recording medium in the detecting position.

11. The inkjet recording apparatus according to claim 7, wherein said positioner controller is configured to place said medium positioner into the non-positioning state from the positioning state, after said first medium feeder stops feeding the recording medium and before said head mover moves said inkjet head.

12. The inkjet recording apparatus according to claim 1, further comprising a feeder controller configured to control said first medium feeder, for causing the recording medium to be fed by said first medium feeder from said first medium accommodator onto said flat horizontal surface of said medium supporter, wherein said first medium feeder includes (i) a feed roller that is to be brought into contact with the recording medium accommodated in said first medium accommodator, (ii) a rotational force applier configured to apply a rotational force to said feed roller such that the recording medium is fed by rotation of said feed roller, (iii) a roller holder holding said feed roller and displaceable for causing said feed roller to be selectively positioned in a contact position in which said feed roller is in contact with the recording medium and a non-contact position in which said feed roller is not in contact with the recording medium, and (iv) a displacer configured to displace said roller holder so as to position said feed roller in a selected one of the contact position and the non-contact position, and wherein said feed controller controls said rotational force applier and said displacer such that the rotational force is applied to said feed roller while said feed roller is positioned in the contact position.

13. The inkjet recording apparatus according to claim 12, wherein said first medium feeder includes, in addition to said feed roller as a first feed roller, said rotational force applier as a first rotational force applier, said roller holder as a first roller holder and said displacer as a first displacer, (v) a second feed roller that is to be brought into contact with the recording medium fed by said first feed roller, so as to cooperate with said flat horizontal surface of said medium supporter for gripping the fed recording medium, (vi) a second rotational force applier configured to apply a rotational force to said second feed roller such that the recording medium is fed by rotation of said second feed roller, (vii) a second roller holder holding said second feed roller and displaceable for causing said second feed roller to be selectively positioned in a contact position in which said second feed roller is in contact with the recording medium and a non-contact position in which said second feed roller is not in contact with the recording medium, and (iv) a second displacer configured to displace said second roller holder so as to position said second feed roller in a selected one of the contact position and the non-contact position, and wherein said feed controller controls said second rotational force applier and said second displacer such that the rotational force is applied to said second feed roller while said second feed roller is positioned in the contact position.

14. The inkjet recording apparatus according to claim 13, wherein said second feed roller is, when being positioned in the non-contact position by said second displacer, spaced apart from the recording medium supported on said flat horizontal surface of said medium supporter, by a distance that allows passage of said inkjet head between said second feed roller and the recording medium.

15. The inkjet recording apparatus according to claim 1, wherein said second medium feeder comprises an element configured to contact the recording medium supported on said flat horizontal surface of said medium supporter, and wherein, when said element contacts the recording medium supported on said flat horizontal surface of said medium supporter, said element is configured to feed the recording medium that is supported on said flat horizontal surface of said medium supporter from said flat horizontal surface toward said second medium accommodator in the single medium unloading direction.

16. The inkjet recording apparatus according to claim 1, wherein said inkjet head is configured to perform a recording operation on the recording medium when the recording medium is positioned in a predetermined position relative to said flat horizontal surface of said medium supporter, and wherein, after the recording operation, said second medium feeder is configured to horizontally feed the recording medium in the single medium unloading direction directly from the predetermined position toward said second medium accommodator.

* * * * *